US011166535B2

(12) United States Patent
Lam

(10) Patent No.: US 11,166,535 B2
(45) Date of Patent: Nov. 9, 2021

(54) RAZOR BLADE CLEANING DEVICE, SYSTEM AND METHOD

(71) Applicant: David Lam, Southport (GB)

(72) Inventor: David Lam, Southport (GB)

( * ) Notice: Subject to any disclaimer, the term of this patent is extended or adjusted under 35 U.S.C. 154(b) by 554 days.

(21) Appl. No.: 15/741,828

(22) PCT Filed: Jul. 10, 2015

(86) PCT No.: PCT/GB2015/000208
§ 371 (c)(1),
(2) Date: Jan. 4, 2018

(87) PCT Pub. No.: WO2017/009589
PCT Pub. Date: Jan. 19, 2017

(65) Prior Publication Data

US 2018/0192757 A1 Jul. 12, 2018

(51) Int. Cl.

| | |
|---|---|
| ***A45D 27/46*** | (2006.01) |
| ***A45D 27/48*** | (2006.01) |
| ***B26B 21/06*** | (2006.01) |
| ***B26B 21/22*** | (2006.01) |

(52) U.S. Cl.
CPC ..... *A45D 27/46* (2013.01); *A45D 27/48* (2013.01); *B26B 21/06* (2013.01); *B26B 21/222* (2013.01)

(58) Field of Classification Search
CPC ..... A45D 27/46; A45D 27/48
See application file for complete search history.

(56) References Cited

U.S. PATENT DOCUMENTS

| | | | | |
|---|---|---|---|---|
| 4,838,949 | A * | 6/1989 | Dugrot | A45D 27/46 134/166 R |
| 8,763,619 | B2 * | 7/2014 | Lele | B08B 3/006 134/147 |
| 2005/0126610 | A1 * | 6/2005 | Hoser | A45D 27/46 134/95.2 |
| 2006/0283487 | A1 * | 12/2006 | Grabowski | A45D 27/46 134/184 |
| 2015/0189981 | A1 * | 7/2015 | Belitz | B08B 3/02 134/34 |

FOREIGN PATENT DOCUMENTS

| | | | | |
|---|---|---|---|---|
| DE | 3125940 | A1 * | 1/1983 | B08B 3/02 |

OTHER PUBLICATIONS

English Machine Translation of DE 3125940 A1.*

* cited by examiner

*Primary Examiner* — Nicole Blan

(57) ABSTRACT

A razor blade cleaning device (10), for cleaning the or each blade of a safety razor or cartridge, comprises an open cleaning chamber, suitably dimensioned for receiving a razor head or cartridge, wherein the device is configured such that a fluid is feedable through the cleaning chamber to contact the blades of a razor head or cartridge disposed therein.

30 Claims, 5 Drawing Sheets

RAZOR BLADE CLEANING DEVICE, SYSTEM AND METHOD

The present invention relates to a razor blade cleaning device, particularly a razor blade cleaning device for cleaning a plurality of razor blades such as, for example, a plurality of razor blades housed in a head of a razor or in a cartridge head attachable to a razor handle.

Razors for shaving hair from the body of humans and animals are well known and are used in a number of industry sectors such as, for example, hair salons and barber shops, spa centres, medical centres, hospitals, veterinary clinics and animal groomers.

Moreover, the provision of shaving as a service is increasingly being offered in retail outlets such as, for example, in beauty salons and barbers. This is particularly so in retail outlets which cater for men as the number of men regularly shaving their heads is increasing.

A straight razor, also know as a cut-throat or open razor, is probably the oldest commercialised razor blade, having being first made in the $17^{th}$ century. A straight razor typically has a blade which is pivotably attached to a handle such that the blade edge can be closed into the handle when not being used. Although straight razors are still used in professional salons and barbers' shops, they require considerable skill to hone and strop and require significant care in use as they are only effective when the blade is kept extremely sharp. However, they are well-known for providing a very clean shave, if used skillfully.

Because of the requirement to keep the blade extremely sharp, a user must be trained in the appropriate skills for shaving a client, which is relatively expensive. Additionally, handling such a sharp and potentially dangerous blade on a client means that there are safety and potential liability issues which need to be considered should the skin of a client be inadvertently cut during a shave.

In order to overcome the safety issues of the straight razor, a safety razor was invented in the $19^{th}$ century, which had a cutting edge of a blade fixed at a right-angle relative to the handle. This arrangement of blade edge and handle provided more certainty for a user that the cutting edge of the blade was contacting the skin at an angle that was less likely to result in a cut through the skin and, at the same time, provided an optimum cutting angle for cutting the hair.

Numerous improvements on the safety razor have been made including a multi-blade safety razor which has a plurality of blades either formed or moulded into the head of a razor or formed or moulded into a disposable cartridge which is detachably attachable to a razor handle. Multi-blade razors have become the most popular razors because they are known to provide a close shave and also provide the safety features of a safety razor.

However, the multi-blade safety razor is disadvantaged in that shaved hair lodges and becomes stuck in between the razor blades. This can lead to the build-up of dirt and debris, such as, for example, hair, skin and other particles, creating an environment in which bacteria can flourish. Moreover, hair lodged around and in between blades also reduces the cutting effectiveness of the razor. This results in the possibility of bacteria entering a cut in the shaved region and an unreliable consistency of shave.

It is therefore desirable in the industry for there to be a device and method for enabling a relatively safe and close shave of reliable consistency.

It is an object of the present invention to provide a device, system and method which seeks to overcome the above-mentioned problems with existing means and methods of shaving.

According to a first aspect of the present invention there is provided a razor blade cleaning device, for cleaning the or each blade of a safety razor or cartridge, the cleaning device comprising an open cleaning chamber, suitably dimensioned for receiving a razor head or cartridge, wherein the device is configured such that a fluid is feedable through the cleaning chamber to contact the blades of a razor head or cartridge disposed therein.

The cleaning device advantageously comprises a base, having a razor head or cartridge receiving portion, and a cleaning head, wherein internal surfaces of the receiving portion and the cleaning head define the open cleaning chamber.

The base advantageously comprises at least one first opening and at least one fourth opening.

The cleaning head advantageously comprises at least one second opening and at least one third opening.

The, or each, first opening, of the base, is advantageously in fluidic communication with the, or each, second opening, of the cleaning head.

The, or each, third opening is advantageously arranged to overlie at least part of the receiving portion.

The, or each, fourth opening is advantageously disposed in the receiving portion of the base.

The, or each, second opening is advantageously operable as an inlet opening to receive fluid from the, or each, first opening, which is operable as an outlet opening.

The, or each, third opening is advantageously operable as an outlet opening to deliver fluid into the cleaning chamber and the, or each, fourth opening is operable as an inlet opening to remove waste from the cleaning chamber.

A vacuum source is advantageously dispcsed to underlie the fourth opening.

In a second mode of operation, the or each, fourth opening is advantageously operable as an inlet opening to deliver fluid into the cleaning chamber and the, or each, third opening is operable as an outlet to remove fluid from the cleaning chamber.

In the second mode of operation, the, or each, first opening is advantageously operable as an inlet opening to receive fluid from the, or each, second opening, which is operable as an outlet opening.

The, or each, second opening may be formed as a nozzle operable to accelerate the fluid passing therethrough. Alternatively, the, or each, second opening may be formed as a slit. The, or each, nozzle or slit may be made from a metal or formed from a plastics material and may be detachably attachable to the cleaning head.

The cleaning head preferably comprises a plurality of second openings. The plurality of second openings are advantageously arranged in one or more lines.

The cleaning head is advantageously in the form of a manifold.

The cleaning device advantageously further comprises a waste disposal system operable to remove waste from the cleaning chamber.

The waste disposal system may comprise a waste container. The waste container is advantageously in fluidic communication with the, or each, fourth opening.

The cleaning device advantageously further comprises means for pressurising the fluid prior to entering the cleaning chamber.

The means for pressurising the fluid advantageously comprises at least one of a pump and vacuum.

The cleaning device advantageously further comprises a controller operable to control at least one of a fluid pressure, fluid temperature, purge cycle, a cleaning cycle and usage monitoring.

The cleaning device advantageously further comprises a usage logger.

The usage logger advantageously comprises a data storage device.

The usage logger advantageously comprises a transmitter for transmitting usage data to a remote location.

The transmitter preferably comprises a wireless communication link.

A cleaning cycle is advantageously activated upon detection of a razor head or cartridge within the cleaning chamber.

A purge cycle is advantageously activated upon detection of the removal of a razor head from the cleaning chamber.

The cleaning device advantageously comprises sensor means for determining the presence of a razor head or cartridge in the cleaning chamber.

The sensor means advantageously comprises a micro-switch.

The cleaning device advantageously further comprises a blade sharpener for sharpening the blades of a razor head when the razor head is inserted in the cleaning chamber.

The cleaning device advantageously further comprises a financial transaction system.

According to a second aspect of the present invention a razor blade cleaning system comprises a razor blade cleaning device, according to the first aspect of the present invention, and a cleaning trolley, wherein the cleaning trolley comprises at least one of: a data transmitter/receiver; a usage logger; a data storage device; a controller; a power source; a fluid source; a pump; a vacuum source; a fluid temperature regulator; and a fluid pressure regulator.

According to a third aspect of the present invention a method of cleaning one or more blades of a safety razor, comprises: providing a razor blade cleaning device, in accordance with the first aspect of the present invention, or a system according to the second aspect of the present invention; inserting a razor blade head or cartridge into the cleaning chamber; supplying a fluid to the cleaning chamber, and cleaning the at least one razor blades of the inserted head or cartridge.

The method advantageously further comprises purging the cleaning chamber.

The method advantageously further comprises logging usage of cleaning device.

The usage is advantageously determined from the number of cycles of at least one of the cleaning and purging.

The method advantageously further comprises storing logged usage data on a data storage device.

The method may further comprises transmitting logged usage to a remote location.

The method may further comprises providing a controller and controlling at least one of the cleaning, purging, drying, usage logging and transmitting.

The method may further comprise providing a detecting device for detecting the presence of a razor head or cartridge and monitoring the cleaning chamber.

A cleaning cycle is advantageously activated upon detection of a razor head or cartridge within the cleaning chamber.

A purging cycle is advantageously activated upon detection of a razor head or cartridge having been removed from the cleaning chamber.

The method advantageously comprises: providing a blade sharpener for sharpening at least one of the one or more blades of an inserted razor head or cartridge and sharpening one or more of the blades.

Embodiments of the present invention will now be described in more detail, by way of example, with reference to the accompanying drawings, in which.

Figure 1:
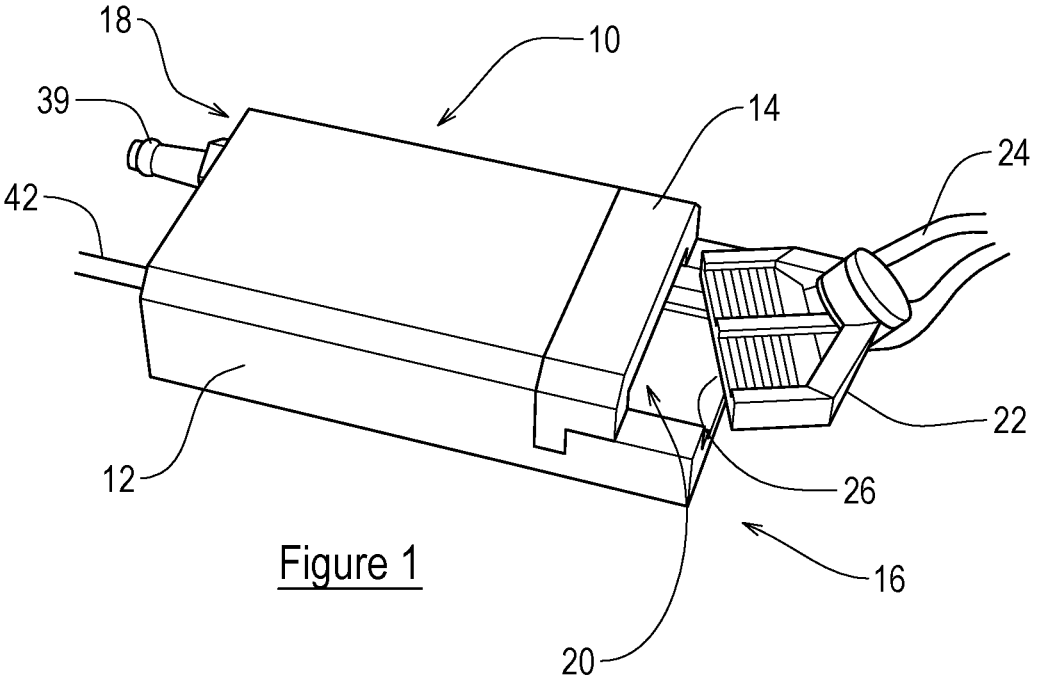
FIG. 1 is a drawing of a perspective view of a razor blade cleaning device, according to embodiments of the present invention, being used with a safety razor.

Referring to FIGS. 1 to 9, a razor blade cleaning device 10 has a base 12 and a cleaning head 14. The base 12 has a front end 16 and a rear end 18.

The device 10 may be made at least partially from, for example, aluminium or stainless steel. Alternatively, the device may be at least partially made from a plastics material.

The base 12 has a receiving portion 20 for receiving a head 22 (or cartridge) of a razor 24. The receiving portion 20 comprises a region of reduced depth 26 defined by a floor 28 and a pair of opposing side walls, 30 and 32, extending, in normal use, upwardly from the level of the floor 28. The height and length of each side wall, 30 and 32, and the distance between the walls is suitably dimensioned to receive the head 22 of the razor 24.

The base 12 has an abutment wall 34 extending substantially perpendicularly from the floor 28. First and second positioning slots, 36 and 38, are disposed between each side wall, 30 and 32, and the abutment wall 34.

A main fluid opening 39 is disposed at the rear end 18, of the base 12 and is connectable to a fluid source.

Figure 3:
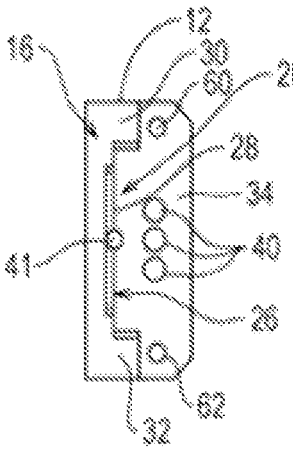
FIG. 3 is a drawing showing a front end of the base of FIG. 2.
Figure 2:
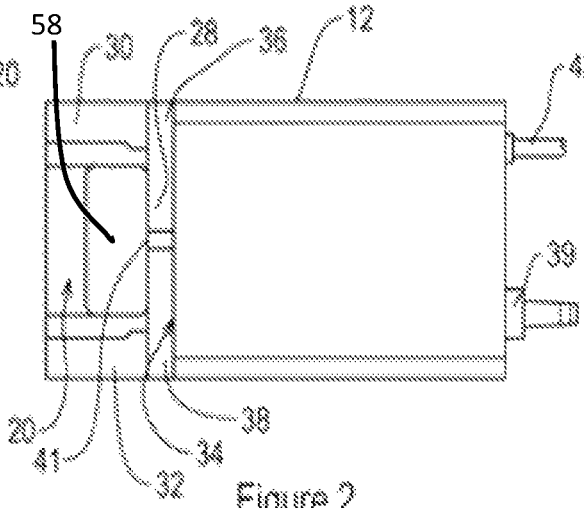
FIG. 2 is a drawing showing an overhead view of the base of the device of FIG. 1.
Figure 4:
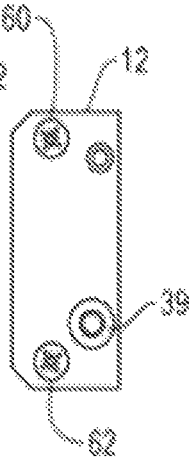
FIG. 4 is a drawing showing a rear end of the base of FIG. 2.
Figure 5:
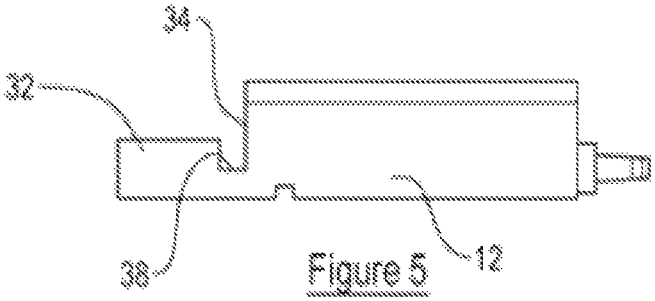
FIG. 5 is a drawing showing a side view of the base of FIG. 2.

A plurality of first openings 40 are disposed in the abutment wall 34. FIG. 3 shows three first fluid openings 40. However, one first opening or a different number of first openings 40 may be used for different applications. The first fluid openings 40 are in fluidic communication with the main fluid opening 39 in a manifold-type of arrangement, such that fluid is able to pass through the main fluid opening 36 and then through the first fluid openings 40 and vice-versa.

A sensor, which may be in the form of a micro-switch 41, is suitably positioned in the receiving portion 20 for engaging with a head 22 (or cartridge) of a razor 24. The sensor is connected to a signal output cable 42.

Referring particularly to FIGS. 6, 7, 8 and 9, the cleaning head 14 has an abutment wall 43 having a second fluid opening 44, which may be in the form of a slot 46. The second opening 44 may have a base portion 48 on a plane substantially perpendicular relative to the abutment wall 43. The drawings show a single second opening 44. However, a plurality of second openings may be used for different applications.

A plurality of third openings 50 may extend through the base portion 48 from inside the second opening 44 such that they open into an external surface 52 of the base portion.

The third openings 50 may be in the form of nozzles operable to accelerate the fluid passing through the third openings 50. Alternatively, the third openings 50 may be in the form of slits. The nozzles or slits may be formed from a plastics, metal or rubber material and may be detachably attachable such that they can be exchanged for other nozzles or slits of different shapes, sizes and diameters of opening.

A seal 54 may be disposed around the second opening (which may be in the form of a slot 46), in a rebate in the abutment wall 43.

Figure 8:
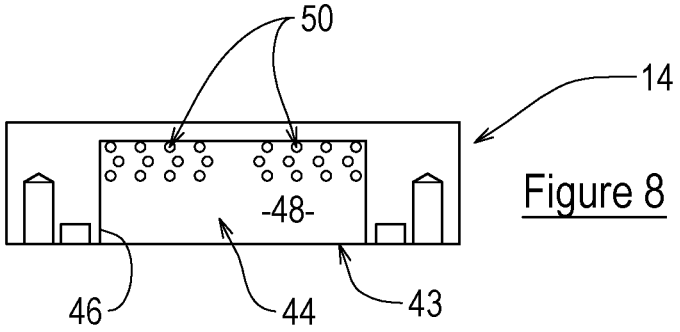
FIG. 8 is a drawing showing a section through A-A of the cleaning head of FIG. 7.
Figure 7:
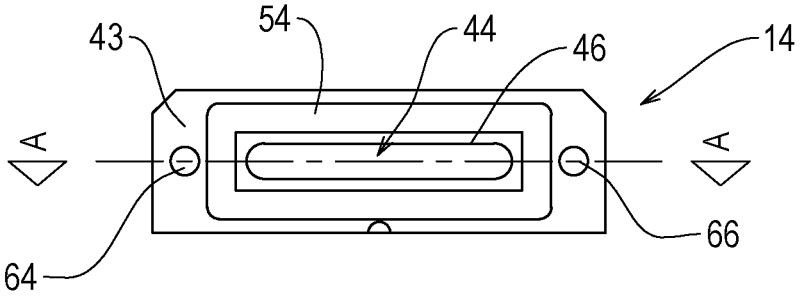
FIG. 7 is a drawing showing the abutment wall of the cleaning head of the device of FIG. 1.
Figure 9:
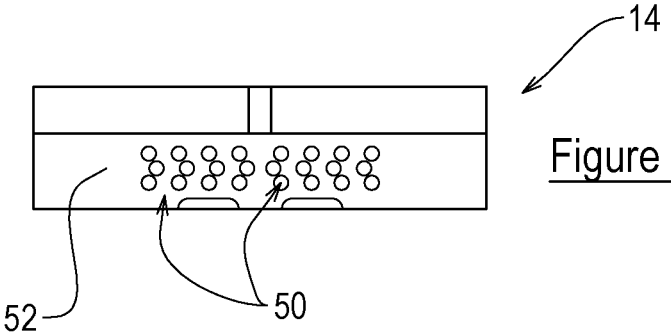
FIG. 9 is a drawing showing an underside view of the cleaning head of FIG. 7.

FIGS. 8 and 9 show twenty-four third openings 50 arranged in a pattern having three parallel lines. However, a single third opening or a different number of third openings 50 may be arranged in different patterns depending on the number and type of blades being cleaned.

The abutment wall 43 may extend below the height of the external surface 52 of the base portion 48 such that a positioning member 56 is formed across a lower portion of the cleaning head 12. The positioning member 56 is dimensioned to fit within the positioning slots, 36 and 38, of the base 12.

Referring again to FIG. 2, a fourth opening 58 may be disposed in the floor 28 of the receiving portion 20 of the base 12. The drawings show a single fourth opening 58. However, a plurality of fourth openings may be used for different applications. A vacuum source (not shown) may be disposed to underlie the fourth opening 58.

Referring again to FIGS. 3 and 4, the base 12 may have a pair of attachment openings, 60 and 62, which extend, parallel to each other, from the rear 18 through to the abutment wall 34, of the base 12.

Referring again to FIGS. 7 and 8, the cleaning head 14 may have a pair of threaded holes, 64 and 66, disposed in the abutment wall 43.

The cleaning head 14 may be attached to the base 12 by two threaded screws (not shown) which are inserted through the attachment openings 60 and 62, of the base, and into the threaded holes 64 and 66, of the cleaning head. The screws engage with the threaded holes, 64 and 66, to screw the abutment wall 43, of the cleaning head 14, onto the abutment wall 34, of the base 12. As the screws are tightened, the first openings 40, of the base 12, are aligned with the second opening 44, of the cleaning head 14, and the seal 54 is compressed between the abutment walls, 34 and 43, such that a fluid seal is formed around the interface between the first openings 40 and the second opening 44.

Figure 6:
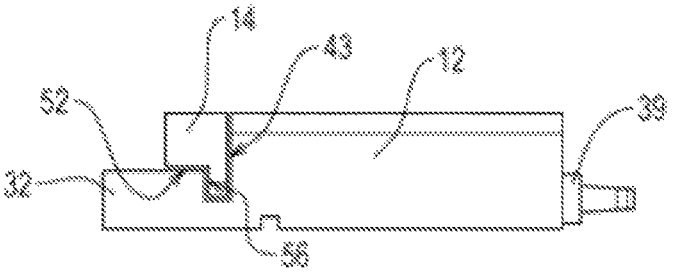
FIG. 6 is a drawing showing a side view of the cleaning head mounted on the base of FIG. 2.

Referring to FIG. 6, with the cleaning head 14 attached to the base 12, the positioning member 56, of the cleaning head, may be positioned in the positioning slots, 36 and 38, of the base, and the external surface 52, of the cleaning head base portion 48, may extend between the side walls, 30 and 32, of the base 12 to provide an open ended cleaning chamber. This open ended cleaning chamber may be defined by the internal surfaces of the side walls, 30 and 32, the floor 28, of the receiving portion 20, and the external surface 52, such that the third openings 50 overlie at least part of the cleaning chamber. The open ended cleaning chamber is suitably dimensioned to receive a head (or cartridge) 20 of a known or specifically designed razor 24.

Figure 10:
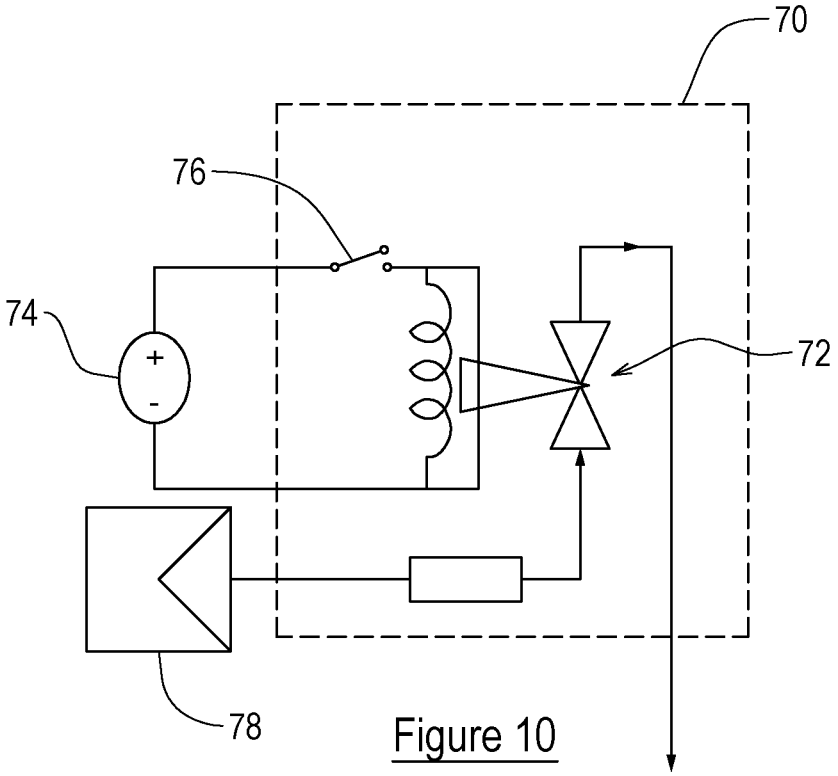
FIG. 10 is a schematic drawing showing the fluid switch of the device of FIG. 1.

Referring to FIG. 10, the device 10 may further comprise a fluid supply valve 70 which may have a solenoid valve 72 connected to a power supply 74 through a switch 76 such that the solenoid valve 72 is opened upon closing the switch 76 and fluid flows from a fluid supply inlet 78 towards the first opening 40 and into the open ended cleaning chamber.

The fluid may be a liquid, such as, for example, water, or a water based cleaning solution, or a gas such as, for example, air.

The device 10 may further comprise a fluid temperature regulator (not shown) and/or a fluid pressure regulator (not shown) for regulating the temperature and pressure of the fluid.

The device 10 may further comprises a transmitter (not shown) for transmitting data to a remote location such as, for example, over the internet using at least one of a modem, switch and router, such as an ISR (Integrated Services Router). In such a case the transmitter would be in the form of an internet router. All these components are known and standard in the industry.

A controller (not shown) may be used to control the temperature regulator, pressure regulator and transmitter.

Figure 11:
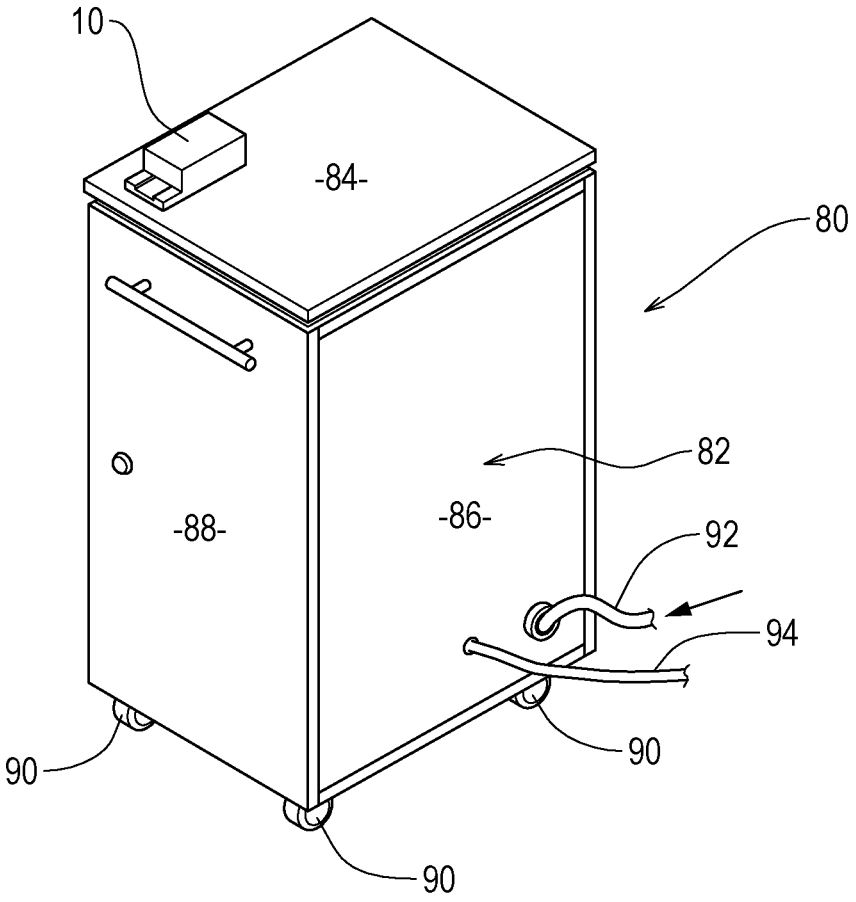
FIG. 11 is a drawing of a razor blade cleaning system according to the present invention.

Referring to FIG. 11, the device 10 may be integrated with, or connected to, a vehicle such as a trolley 80. The device 10 can therefore be powered from the trolley 80 or can have an independent power source which may be a rechargeable battery.

The trolley 80 may comprise a cabinet 82 having a work top 84, a first side wall 86, a second side wall (not shown), a rear wall (not shown) and a base (not shown) and a door 88. The trolley 80 may mounted on a set of wheels 90 such that it can be easily moved over a floor. However, the trolley 80 may additionally, or alternatively, be portable, static, wall mounted, fixed or mounted on an extendable arm.

The trolley 80 may have a fluid inlet connection 92 and/or a power supply inlet 94. The fluid inlet connection 92 may be plumbed directly to the mains water supply on a gravity flow or pumped fluid supply. Inside the trolley 80 there may be a waste container (not shown) in which the waste from the device 10 is collected. The waste container may be plumbed into a main drain under gravity or may also be pumped away using a known type of sanitary pump mechanism. The waste container may have a level sensor which, upon detecting that the waste is above a predetermined level, sends a "waste full" signal to the controller. Upon receiving a "waste full" signal, the controller may prevent any wash or purge cycles being triggered. The trolley 80 may also house the controller, timer, temperature regulator, pressure regulator and transmitter. The fluid supply valve 70 may also be housed in the trolley 80.

The trolley 80 may also have a towel heater for heating towels to a predetermined desired temperature suitable for use with shaving.

Figure 12:
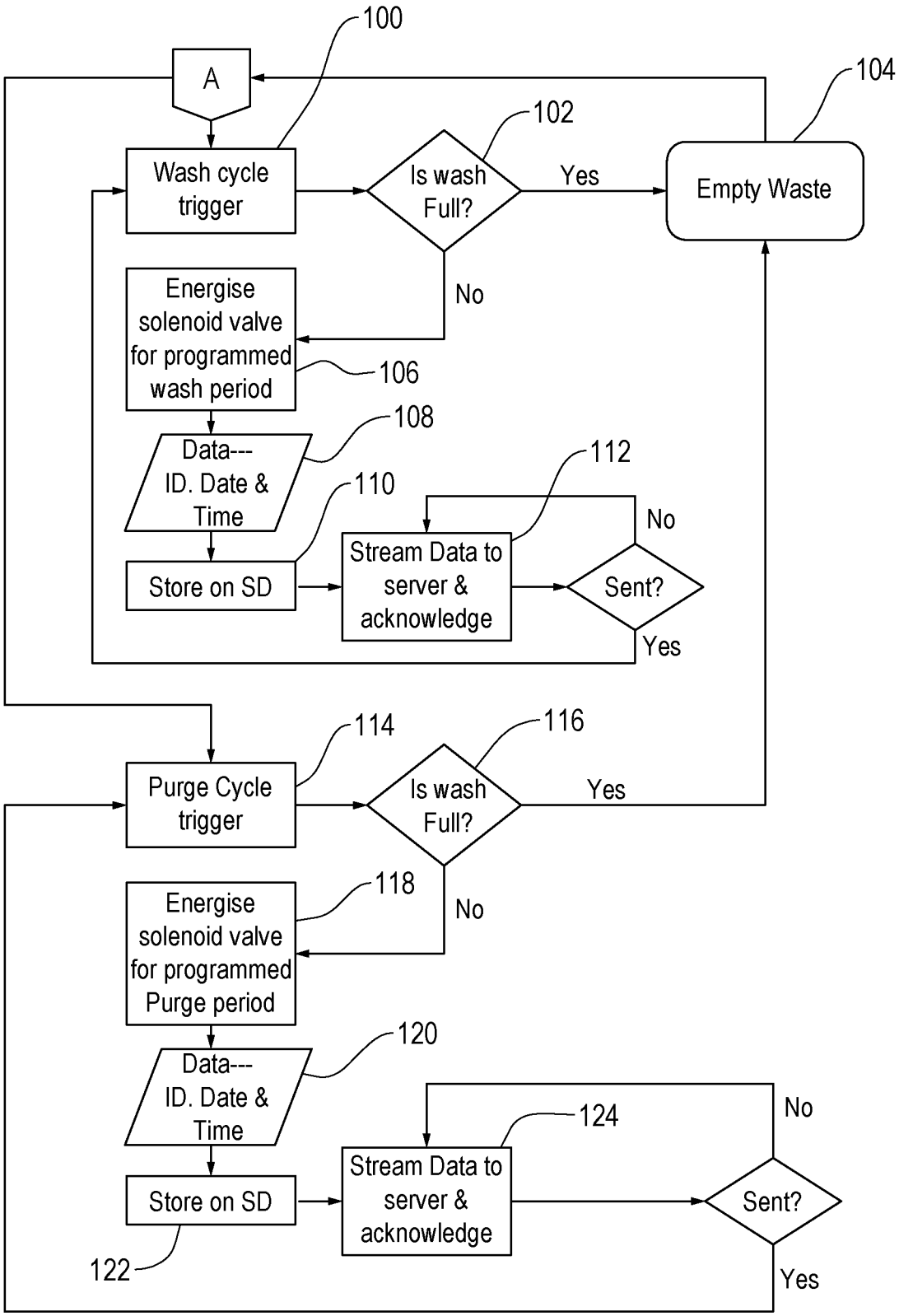
FIG. 12 is a drawing showing a method for cleaning the blades of a razor head according to the present, invention, using the device of FIG. 1.

Referring also to FIG. 12, in use, upon a wash cycle being triggered 100, a waste full check is carried out 102. If the waste container is full, the user may be prompted to empty the waste 104. If the waste container is not full, the controller may send a signal to close switch 76 and the solenoid valve 72 is energised 106 to allow fluid to flow to the first openings 40 and from there through the second and third openings, 44 and 50, through the cleaning chamber and out through the fourth opening 58 to the waste container (not shown). In such a mode of operation, the first openings 40, the third openings 50 and the fourth opening 58 are operable as outlet openings and the second opening 44 is operable as an inlet opening.

As an option, the system may have a billing process whereby, upon energising the solenoid valve 72, the identification of the user, date and time is logged 108 by the usage logger and stored 110 on a data storage device, such as, for example, an SD data storage card. The data may then be transmitted to a remote server for billing the user 112.

The fluid is preferably a liquid, such as water or a water based cleaning fluid. However, it may alternatively be a gas, such as air, or a combination of liquid and gas. The fluid can be pressurised and/or heated, using a pump and/or heater (not shown), up-stream from the cleaning head 14, which may be upstream or downstream from the fluid switch 70.

With the razor head 22 positioned in the cleaning chamber 18 a vacuum source, disposed to underlie the fourth opening 58, may be used to assist with keeping the razor head (or cartridge) 22 correctly positioned.

The fluid forces lodged hair and other debris off the blades and from in-between the blades as it passes through the razor head 22. The hair and debris is carried by the fluid and is collected in the waste container (not shown), housed in the trolley 80.

The wash cycle may be triggered 100 upon activation of the sensor disposed in the cleaning chamber, which is triggered by a razor head 22 being correctly placed in the cleaning chamber.

Alternatively, the wash cycle may be triggered by detection of a Near Field Communication (NFC) or ID recognition signal between the razor head 22 and the cleaning device 10.

The wash cycle may continue for a predetermined period of time controlled by the controller (not shown). Alternatively, or additionally, the wash cycle may continue until a predetermined volume of fluid has been fed into or passed through the cleaning chamber.

During the purge cycle, the device 10 is cleaned without a razor head 22 being located in the cleaning chamber 18.

The purge cycle is triggered 114 either manually or upon the sensor in the cleaning chamber being deactivated. Upon the purge cycle being triggered 114, a waste container full check is carried out 116. If the waste container is not full, the switch 76 may be closed and the solenoid valve 72 is energised 118 to allow fluid to flow to the cleaning head 14.

Upon energising the solenoid valve 72, the identification of the user, date and time may be logged 120 by the usage logger and stored 122 on a data storage device, such as an SD data storage card. The data may be then transmitted to the remote server for billing the user 124. The identification of the user is matched with pre-stored identification details to match the user with a specific device 10 and/or trolley 80.

The fluid used in the purge cycle is preferably a liquid, such as water or a water based cleaning fluid. However, it may alternatively be a gas, such as air, or a combination of liquid and gas. The fluid can be pressurised and/or heated, using a pump and/or heater (not shown), up-stream from the cleaning head 14, which may be upstream or downstream from the fluid switch 70.

The purge cycle may continue for a predetermined period of time and may be controlled by the controller (not shown). Alternatively, or additionally, the purge cycle may continue until a predetermined volume of fluid has been fed into or passed through the cleaning chamber.

Additionally, a vacuum may be used to drive the fluid through the blades of the razor head 22 (or cartridge). In which case, the vacuum source is disposed below the device 10 and the razor head 22 (or cartridge) forms a fluid seal with the chamber such that fluid is sucked at relatively high velocity through between the blades to dislodge and expel the debris attached thereto.

By using one or more pumps and/or a vacuum, the direction of fluid flow can be switched. For example, the fluid may flow in a first direction through the first 40, second 44, third 50 and then fourth 58 openings, such that: the first openings 40 are operable as outlet openings; the second opening 44 is operable as an inlet opening to receive fluid from the first openings 40, the third openings 50 are operable as outlet openings to deliver fluid into the cleaning chamber; and the fourth opening 58 is operable as an inlet opening to remove waste from the cleaning chamber. The direction of flow may then be switched to a second direction through the fourth 58, third 50, second 44 and then first 40 openings, such that: the fourth opening 58 is operable as an outlet opening to deliver fluid into the cleaning chamber; the third openings 50 are operable as outlet openings to remove fluid from the cleaning chamber; the second opening 44 is operable as an outlet opening; and the first openings 40 are operable as inlet openings to receive fluid from the second opening. Switching the direction of flow can be used to loosen difficult to remove hair and debris from the blades. This switching of direction may be particularly effective if the change in direction involves pulsing the fluid alternatively in the two different directions of flow.

The data logged relating to the cleaning cycles and purge cycles can be used to track the usage of the device 10 which can be used to bill the user accordingly. A device or system for undertaking a financial transaction can also be included whereby credit and debit card transactions can be accepted for a user to credit their user account.

The data logged may also provide information relating to performance, maintenance and commercial profitability of each device 10 used in a retail outlet, or other outlet such as, for example, hospital, surgery, spa, clinic, college, monastery or club.

All the electrical and fluid delivery components may be housed in the trolley 80 such that the device 10 receives fluid through the main fluid opening 39 from a fluid source in the trolley 80 or fed through the trolley 80.

The device 10 may also comprise a razor recogniser for identifying razors 24, or razor heads (or cartridges) 22 belonging to individual users. The razor recognition means may comprise Near Field Communication (NFC) or other similar technology suitable for identifying specific razors 24 or razor heads (or cartridges) 22.

The wash cycle can be followed by a drying cycle, whereby air, which may be heated, is introduced into the cleaning chamber, through the first 40, second 44 and third 50 openings, or through the fourth opening 58, to dry the washed blades.

In an embodiment, the device 10 additionally comprises a blade sharpener for sharpening the blades.

The cleaning device 10 or trolley 80 may additionally have a GPS unit to determine its location. The location can then be communicated to existing and potential customers to inform them of their nearest service. The GPS information may also be used for determining the position of lost or stolen devices 10 and trolleys 80 and for determining marketing and sales regions.

In another aspect of the invention, the razor blade cleaning device 10 can be used as part of a commercial shaving system whereby the user is a commercial entity such as, for example, a hair and beauty salon or men's barber shop.

For example, men who choose to shave their heads require a close shave on a frequent basis in order to keep a desired clean shaven style. They also require a hygienic and safe shaving experience. Moreover, it can be difficult to shave some parts of the body by oneself, such as, for example, the scalp and genital area. There is therefore a need for a professional commercial shaving system and service.

The commercial shaving system, according to the present invention, comprises a razor blade cleaning device 10 and trolley 80 as previously described above.

The fluid supply, fluid switch, waste container, data transmitter and receiver, and controller may all be contained within the trolley 80.

A frequent customer of a professional user, using the commercial shaving system, may hold ownership of his or her personal razor 24, or razor head (or cartridge) 22, such that he or she is the only person who is shaved with that razor. Moreover, the frequent customer may also maintain ownership of his or her own products, such as pre-shave and post-shave products and towels. All towels may be cleaned to clinical standards to minimise infections.

The regular customer's personal razor 24 or razor head (or cartridge) 22 and products may be kept in a personal lockable cupboard or container in the premises of the professional user. The cupboard or container may be locked and unlocked using a code or other number such as a mobile telephone number or through a mobile telephone application. The code may be programmable through the cleaning device 10 or trolley 80.

When the user attends for a shave, he or she gains access to their personal razor 24 or shaver head (or cartridge) 22 and products.

During the shave, the head 22 of the personal razor 24 is inserted in the cleaning chamber of the razor blade cleaning device 10. The presence of the head 22 in the cleaning chamber may be detected by the sensor and a signal may be transmitted to the controller. Upon receipt of the signal, the controller may trigger a wash cycle, as shown in FIG. 12.

As an additional feature, the razor 24, or razor head (or cartridge) 22, may have an identification tag, such as, for example, a Near Field Communication (NFC) identification tag, for identifying the user. The data resulting from identifying the user can be used for subsequent billing of the user.

After successfully undertaking a waste container-full test 102/116, the identification of the professional user may be logged along with the date, time and duration of the wash cycle. The same data may be logged for each purge cycle. This logged data may then be transmitted to the remote server and the date and time may be used to bill the professional user for each wash cycle and/or purge cycle.

The system may include pay-as-you-go billing which includes a payment system for making a credit/debit card type transaction. Additionally, or alternatively, the payment system may be for making financial transactions such as, for example, via the telephone, internet website or bank.

The cleaning device 10 may be disabled remotely through the remote server.

In this way an owner of a commercial shaving system will have a number of razor blade cleaning devices 10 and trolleys 80 in different commercial or retail premises and bill remotely for their use by professional users, through the remote server.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A razor blade cleaning device, for cleaning one or more blades of a safety razor or cartridge, the cleaning device comprising: a cleaning head; a base; and an open cleaning chamber, suitably dimensioned for receiving the safety razor or cartridge; wherein the device is configured such that a fluid is feedable through the open cleaning chamber to contact the one or more blades of the safety razor or cartridge disposed therein; wherein the cleaning head is in the form of a manifold having a plurality of cleaning openings extending parallel to a fluid source and relative to each other at an external surface of the cleaning head; and the base comprises a safety razor or cartridge receiving portion, wherein the open cleaning chamber is defined by the receiving portion of the base and the external surface of the cleaning head.

2. The razor blade cleaning device as claimed in claim 1, wherein the base comprises at least one first opening and at least one fourth opening.

3. The razor blade cleaning device as claimed in claim 2, wherein the cleaning head comprises at least one second opening in fluid communication with the plurality of cleaning openings.

4. The razor blade cleaning device as claimed in claim 3, wherein the at least one first opening, of the base, is in fluidic communication with the at least one second opening, of the cleaning head.

5. The razor blade cleaning device as claimed in claim 3, wherein the at least one second opening is operable as an inlet opening to receive fluid from the at least one first opening, which is operable as an outlet opening.

6. The razor blade cleaning device as claimed in claim 5, wherein the plurality of cleaning openings are operable as outlet openings to deliver fluid into the open cleaning chamber and the at least one fourth opening is operable as an inlet opening to remove waste from the open cleaning chamber.

7. The razor blade cleaning device as claimed in claim claim 2, wherein the at least one fourth opening is disposed in the receiving portion of the base.

8. The razor blade cleaning device as claimed in claim 2, wherein a vacuum source is disposed to underlie the at least one fourth opening.

9. The razor blade cleaning device as claimed in claim 2, wherein, in a second mode of operation, the at least one fourth opening is operable as an inlet opening to deliver fluid into the open cleaning chamber and the plurality of cleaning openings are operable as an outlet to remove fluid from the open cleaning chamber.

10. The razor blade cleaning device as claimed in claim 9, wherein the at least one first opening is operable as an inlet opening to receive fluid from the at least one second opening, which is operable as an outlet opening.

11. The razor blade cleaning device as claimed in claim 1, wherein the cleaning openings are arranged to overlie at least part of the receiving portion.

12. The razor blade cleaning device as claimed in claim 1, wherein the plurality of cleaning openings are formed as nozzles operable to accelerate the fluid passing therethrough.

13. The razor blade cleaning device as claimed in claim 12, wherein at least one of the nozzles is detachably attachable to the cleaning head.

14. The razor blade cleaning device as claimed in claim 1, wherein the plurality of cleaning openings are arranged in one or more lines.

15. The razor blade cleaning device as claimed in claim 1, further comprising a waste disposal system operable to remove waste from the open cleaning chamber.

16. The razor blade earring device as claimed in claim 15, wherein the waste disposal system comprises a waste container.

17. The razor blade cleaning device as claimed in claim 16, wherein the waste container is in fluidic communication with the receiving portion of the base.

18. The razor blade cleaning device as claimed in claim 1, further comprising means for pressurizing the fluid prior to entering the open cleaning chamber.

19. The razor blade cleaning device as claimed in claim 18, wherein the means for pressurizing the fluid comprises at least one of a pump and vacuum.

20. The razor blade cleaning device as claimed in claim 1, further comprising a controller operable to control at least one of a fluid pressure, fluid temperature, purge cycle, a cleaning cycle and usage monitoring.

21. The razor blade cleaning device as claimed in claim 1, further comprising a usage logger.

22. The razor blade cleaning device as claimed in claim 21, wherein the usage logger comprises a data storage device.

23. The razor blade cleaning device as claimed in claim 21, wherein the usage logger further comprises a transmitter for transmitting usage data to a remote location.

24. The razor blade cleaning device as claimed in claim 23, wherein the transmitter comprises a wireless communication link.

25. The razor blade cleaning device as claimed claim 1, wherein a cleaning cycle is activated upon detection of the safety razor or cartridge within the open cleaning chamber.

26. The razor blade cleaning device as claimed in claim 1, wherein a purge cycle is activated upon detection of the removal of safety razor or cartridge from the open cleaning chamber.

27. The razor blade cleaning device as claimed in claim 25 or 26, comprising sensor means for determining the presence of the safety razor or cartridge in the open cleaning chamber.

28. The razor blade cleaning device as claimed in claim 27, wherein the sensor means comprises a micro-switch.

29. The razor blade cleaning device as claimed in claim 1, further comprising a blade sharpener for sharpening blades of the safety razor or cartridge when the safety razor or cartridge is inserted in the open cleaning chamber.

30. The razor blade cleaning device as claimed claim 1, further comprising a financial transaction system.

* * * * *